US006502700B2

(12) United States Patent
Goostree

(10) Patent No.: US 6,502,700 B2
(45) Date of Patent: Jan. 7, 2003

(54) SPACER FOR COILED PRODUCTS

(75) Inventor: Phil Goostree, Cross Plains, TN (US)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/758,522

(22) Filed: Jan. 10, 2001

(65) Prior Publication Data

US 2002/0088739 A1 Jul. 11, 2002

(51) Int. Cl.[7] ..... B65D 19/00
(52) U.S. Cl. ..... 206/597; 206/303
(58) Field of Search ..... 206/303, 386, 206/499, 597, 821, 814; 53/399, 409

(56) References Cited

U.S. PATENT DOCUMENTS

| | | | | | |
|---|---|---|---|---|---|
| 4,998,619 | A | * | 3/1991 | Sowa et al. | 206/597 |
| 5,918,745 | A | * | 7/1999 | Main | 206/597 |
| 6,119,865 | A | * | 9/2000 | Kawada | 206/303 |
| 6,286,684 | B1 | * | 9/2001 | Brooks et al. | 206/303 |

* cited by examiner

*Primary Examiner*—Luan K. Bui
(74) *Attorney, Agent, or Firm*—Smith-Hill and Bedell

(57) ABSTRACT

A spacer for coiled products, said spacer having an essentially flat, preferably disk-shaped body, and acts as a pad interposed between stacked coils, wherein said spacer comprises at least one slot, extending in radial direction a distance from the outer edge or near the outer edge to the center of the spacer.

17 Claims, 2 Drawing Sheets

SPACER FOR COILED PRODUCTS

FIELD OF THE INVENTION

The invention relates to a spacer for coiled products, especially for coiled tube products, said spacer having an essentially flat, preferably disk-shaped body, and act as a pad interposed between stacked coils.

BACKGROUND OF THE INVENTION

It is known to use spacers between stacked coils of coiled products to protect the products, especially during their shipment or storage. The spacers provide for a pad between coils for shipment. The spacer is typically a circular disk-shaped product and made for example from cardboard such as corrugated fiberboard. This kind of spacers have been very useful for stacked coiled products, e.g. for stacked coiled copper tubes. Each coil is bound with at least one band to keep coil loops in order. Before uncoiling the product the band has to be cut and preferably removed. This is necessary when uncoiling the product with so called inner end payoff method (ID payoff). The copper tube coils can be quite heavy and this makes the removal of bands very difficult. When using the known spacers, the coil either have to be lifted or the bands with very sharp edges have to be pulled out from under the coils utilizing extreme force. Either method can cause damage to the product for example to the coil of very fragile, annealed thin wall copper tube. Pulling the band from under the coils can result in band dents in the lower layer of the level wound tube. Lifting the coil can cause portions of the tube to be flattened.

The object of the present invention is to realize a spacer for coiled products, by means of it the drawbacks of the prior art are avoided. Another object of the invention is to realize a spacer that is better suited for the inner end payoff method of level wound coil of tube. A further object of the invention is to provide a spacer suitable to a shipment of level wound coils and for the removal of the bands that contain the coil during shipment without damaging the coil or having to lift the coils. And finally a fourth object of the invention is to provide a spacer that will not catch on the tube while paying off.

SUMMARY OF THE INVENTION

The spacer according to the invention is characterized, among others, in that said spacer comprises at least one slot, extending in radial direction a distance from the outer edge of the center of the spacer. In accordance with one form of the invention said at least one slot is arranged substantially on an area of the spacer body where at least one binding band and like coil confining means and the spacer are abutting each other. The slot may be either open or closed along the outer diameter of the spacer.

In another form of the invention the spacer comprises at least two slots arranged preferably substantially diametrically on the spacer. In third form of the invention the spacer comprises at least four slots divided preferably evenly on the circumference of the spacer.

The slots in the spacer allow the operator to simply cut the bands and pull them out under the coil easily because the slots are located directly under the bands. This can be done without damaging the coiled product or having to lift the product coils. The form of the spacer is very useful and the spacer can be made in a single piece. In addition, the spacer according to the invention gives a very good protection to the coiled product.

BRIEF DESCRIPTION OF THE DRAWINGS

The invention is described in more detail below by means of examples and with reference to the appended drawings, where.

DETAILED DESCRIPTION OF THE PREFERRED EMBODIMENTS

Figure 1:
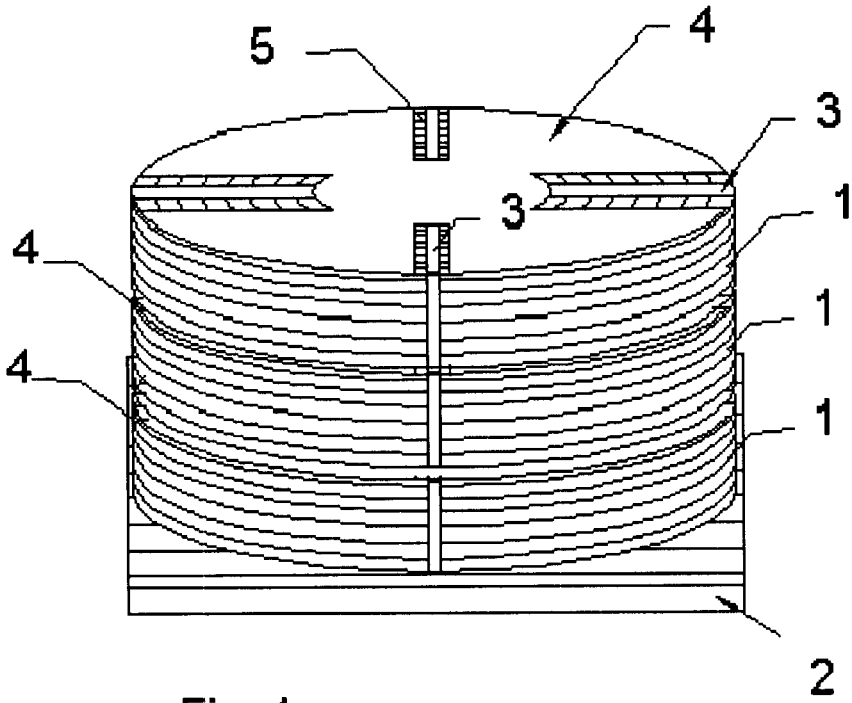
FIG. 1 is a general perspective view of a stack of coils supported on a pallet and with the individual coils separated by spacers
Figure 3:
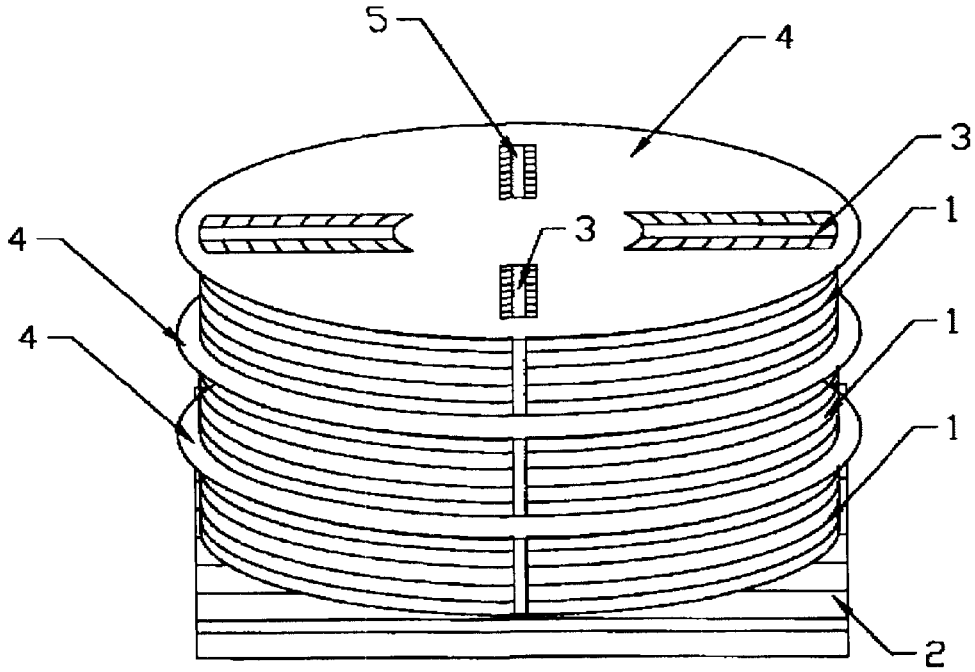
FIG. 3 is a general perspective view of an other embodyment of a stack of coils supported on a pallet and with the individual coils separated by spacers

As shown in the drawings, looking particularly at FIG. 1 and FIG. 3, the coils 1 are stacked vertically one on top of another and the entire stack of coils is on a pallet 2 by means of which the stack of coils may be transported. The coiled products are typically tube products, but they may be of other products such as strip products. The coil 1 is bound by at least one band 3 that contain the coil.

Figure 2:
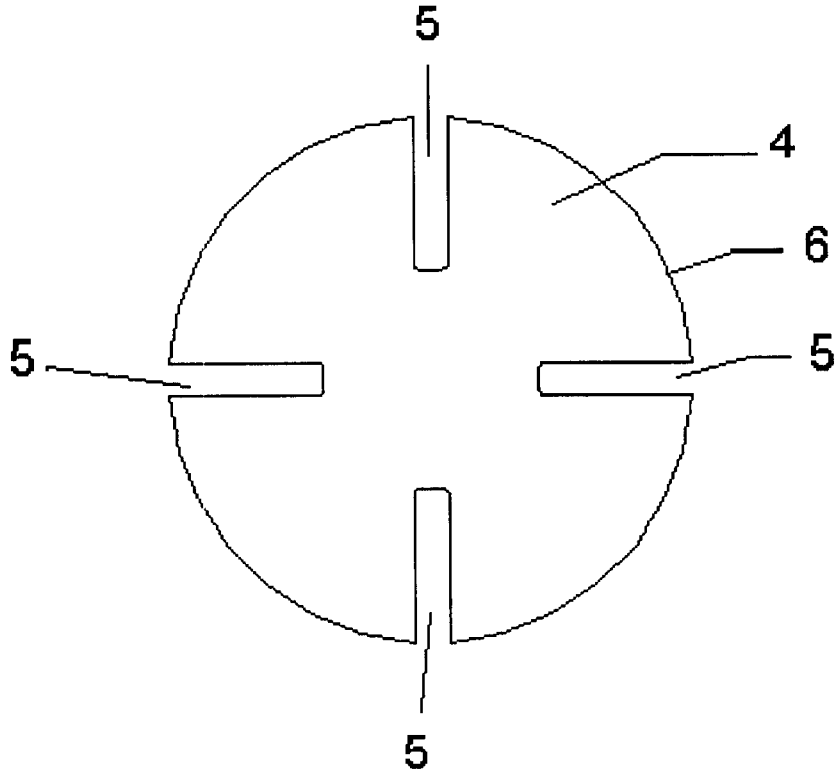
FIG. 2 is a plan view of the spacer according to the invention
Figure 4:
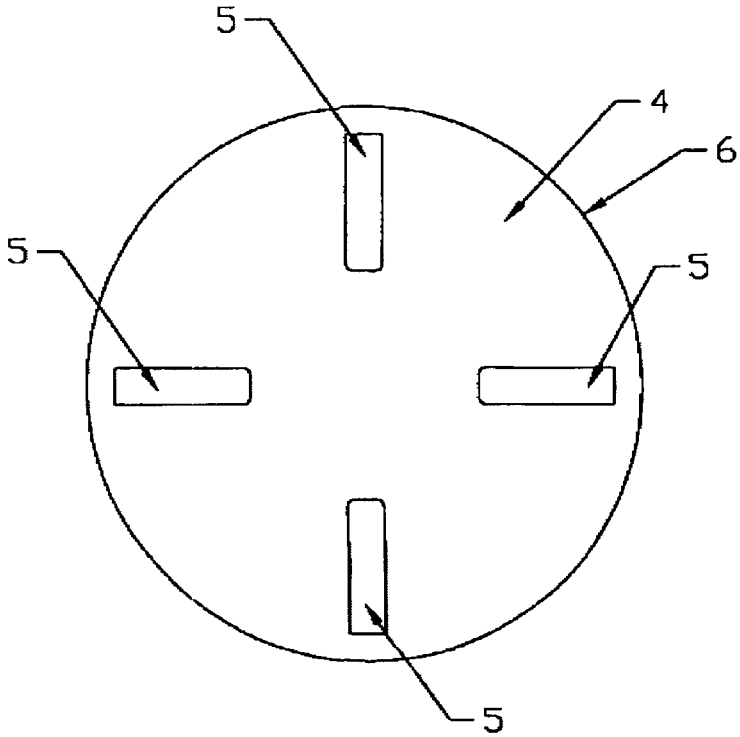
FIG. 4 is a plan view of an other embodyment of the spacer according to the invention.

The invention relates to a spacer 4 for coiled products, said spacer having an essentially flat, preferably disk-shaped body, and acting as a pad interposed between stacked coils 1, wherein said spacer comprises at least one slot 5, extending in radial direction a distance from the outer edge 6 towards the center of the spacer, as shown in FIG. 2, or from a distance from the outer edge 6 towards the center of the spacer, as shown in FIG. 4.

The slot 5 is arranged substantially on an area of the spacer body where at least one binding band 3 and like coil confining means and the spacer 4 are abutting each other. There may be suitable number of slots 5 formed on the spacer. In a one typical embodiment of the invention the spacer 4 comprises at least two slots 5 arranged preferably substantially diametrically on the spacer. In the preferred embodiments shown in FIG. 2 or FIG. 4 the spacer 4 comprises four slots 5 divided preferably evenly on the circumference of the spacer.

The spacer is typically very suitable for the coiled tube product such as thin wall copper tube. The spacer can be made of any suitable material. One preferred material is cardboard such as corrugated fiberboard. The shape of the spacer can be easily cut when using cardboard as spacer material.

The distance the slot 5 is extending from the outer edge 6 or near the outer edge 6 to the center of the spacer body depends of the coil 1 dimensions. The width of the slot 5 depends of the width of the band 3.

What is claimed is:

1. In combination, two coils of an elongate product, each coil being composed of multiple loops and being generally cylindrical in configuration and having a lower main surface, and each coil being provided with a band extending around the coil for confining the loops, the band including a length segment that extends under the lower main surface of the coil, substantially radially with respect to the cylindrical configuration of the coil, the coils being stacked as an upper coil and a lower coil, and a spacer interposed between the upper and lower coils, said spacer being an essentially flat body acting as a pad interposed between the upper coil and the lower coil and having at least one slot extending in a radial direction from a location at or near an outer edge of the spacer towards a central region of the spacer and receiving said length segment of the band of the upper coil.

2. A combination according to claim 1, wherein the spacer is substantially circular.

3. A combination according to claim 1, wherein the spacer has at least first and second slots extending substantially along opposite radii of a common diameter of the spacer.

4. A combination according to claim 1, wherein the spacer has at least two substantially equiangularly spaced slots.

5. A combination according to claim 1, wherein the spacer has a circular outer periphery and has at least two substantially equiangularly spaced slots that are open at the outer periphery of the spacer.

6. A combination according to claim 1, wherein the pad comprises cardboard.

7. In combination, a coil of an elongate product, the coil being composed of multiple loops and being generally cylindrical in configuration and having a lower main surface, a band extending around the coil for confining the loops, the band including a length segment that extends under the lower main surface of the coil, substantially radially with respect to the cylindrical configuration of the coil, and a spacer on which the coil rests, the spacer being formed with a slot that extends substantially radially with respect to the cylindrical configuration of the coil and in which said length segment of the band is located, whereby on cutting the band said length segment can be removed from beneath the coil without lifting the coil or damaging the elongate product.

8. A combination according to claim 7, wherein the spacer is substantially circular.

9. A combination according to claim 8, wherein the spacer is formed with first and second slots that extend substantially along opposite radii of a common diameter of the spacer.

10. A combination according to claim 8, wherein the spacer is formed with a plurality of slots that extend substantially radially of the spacer and are substantially equiangularly spaced about the spacer.

11. A combination according to claim 7, wherein the spacer has a circular outer periphery and has at least two substantially equiangularly spaced slots that are open at the outer periphery of the spacer.

12. A combination according to claim 7, wherein said elongate product is a tube product.

13. A combination according to claim 7, wherein the spacer comprises cardboard.

14. A method of handling a coil of a n elongate product, the coil being composed of multiple loops and being generally cylindrical in configuration and provided with a band extending around the coil for confining the loops, the band including a length segment that traverses a main surface of the coil and extends substantially radially with respect to the cylindrical configuration of the coil, said method comprising providing an essentially flat spacer formed with a slot, and placing the coil on the spacer so that the coil rests on the spacer with said main surface downwards and with said length segment of the band located in the slot, whereby on cutting the band said length segment can be removed from beneath the coil without lifting the coil or damaging the product.

15. A method according to claim 14, wherein the spacer is substantially circular.

16. A method according to claim 14, wherein the coil is provided with first and second bands each including a length segment that traverses said main surface of the coil, and where in said length segments of the first and second bands extend substantially along opposite radii of a common diameter of the cylindrical configuration of the coil, and the spacer is formed with first and second slots and the method comprises placing the coil on the spacer so that said length segments are located in the slots respectively.

17. A method according to cl aim 14, wherein the coil is provided with a plurality of bands each including a length segment that traverses said main surface of the coil and extends substantially radially with respect to the cylindrical configuration of the coil, said length segments being substantially equiangularly spaced with respect to said cylindrical configuration, and wherein the spacer is formed with a plurality of slots and the method comprises placing the coil on the spacer so that said length segments of the bands are located in the slots respectively.

* * * * *